United States Patent [19]

Grass

[11] 4,168,077

[45] Sep. 18, 1979

[54] ANTI-CROSSING DEVICE FOR SKIS

[76] Inventor: Alfred Grass, Mozartstr. 43, D-7982 Baienfurt, Fed. Rep. of Germany

[21] Appl. No.: 862,700

[22] Filed: Dec. 21, 1977

[30] Foreign Application Priority Data

Dec. 28, 1976 [DE] Fed. Rep. of Germany ..... 2640762

[51] Int. Cl.[2] ..... A63C 11/00

[52] U.S. Cl. ..... 280/11.37 E

[58] Field of Search ..... 280/11.37 E, 601, 11.37 R

[56] References Cited

U.S. PATENT DOCUMENTS

| | | | |
|---|---|---|---|
| 2,625,405 | 1/1953 | Staff | 280/11.37 E |
| 3,295,860 | 1/1967 | Von Hoven | 280/11.37 E |
| 3,863,943 | 2/1975 | Giannotti | 280/11.37 E |
| 3,953,043 | 4/1976 | Hinterholzer | 280/11.37 E |

FOREIGN PATENT DOCUMENTS

| | | | |
|---|---|---|---|
| 2418816 | 10/1975 | Fed. Rep. of Germany | 280/11.37 E |
| 2549693 | 5/1977 | Fed. Rep. of Germany | 280/11.37 E |
| 2137348 | 12/1972 | France | 280/11.37 E |

*Primary Examiner*—David M. Mitchell

*Attorney, Agent, or Firm*—Misegades, Douglas & Levy

[57] ABSTRACT

An anti-crossing device to improve efficiency in parallel skiing techniques includes an upright member which is attached to the upper surface of a ski adjacent to the inner longitudinal edge of same. The upright member is molded from a flexible plastic material and comprises an attaching base and a trough-shaped upper portion and is arranged so that the hollow side of the trough is turned towards the other ski. The upright member shows itself to be quite rigid when the skis begin to cross so that it urges the crossing ski back to a more parallel position. When, however, the skis crossed over one another in spite of the provision of the upright member this yields in the other direction, so that the skis may easily be separated from one another.

10 Claims, 9 Drawing Figures

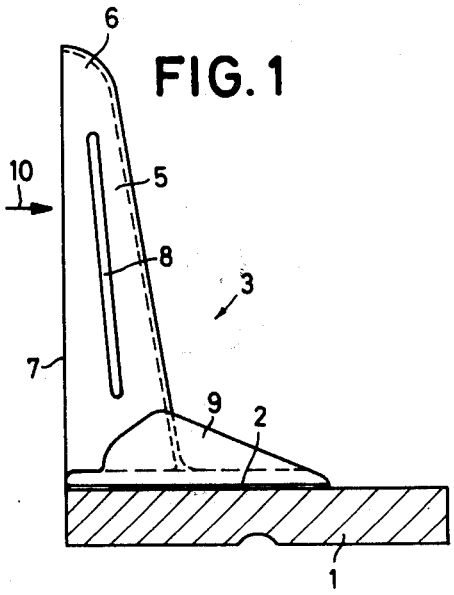
FIG. 1
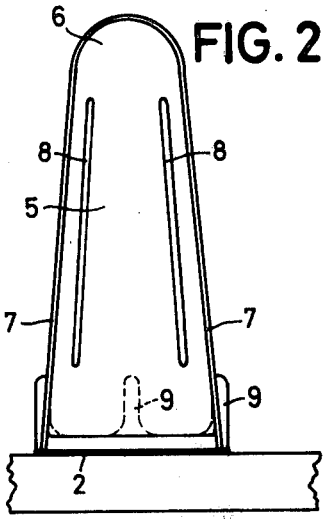
FIG. 2
FIG. 3
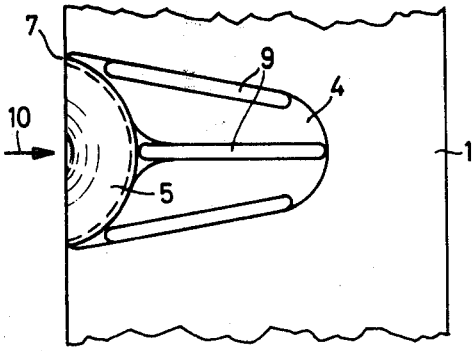
FIG. 7
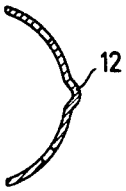

ANTI-CROSSING DEVICE FOR SKIS

BRIEF SUMMARY OF THE INVENTION

This invention relates generally to ski attachments and, in particular, to an anti-crossing device for attachment to the upper surface of a ski adjacent to the longitudinal edge of the ski comprising an upright member and an attaching base. The terms "inward" and "outward" refer to skis placed alongside one another and ready for usage. For example, the term "inward" has the same meaning as "left" with regard to the right ski.

CROSS REFERENCE TO PRIOR ART DISCLOSURE AND FIELD OF THE INVENTION

As far as a known device of this kind is concerned (U.S. Pat. No. 3,863,943), the upright member has the form of an airfoil shaped plate that is springhinged to a base plate. The pivot axis is parallel and closely adjacent to the inner edge of the ski. The spring presses the pivotable member against a stop, so that it stands substantially perpendicular to the surface of the ski. The plate offers resistance to a force which endeavours to pivot it outwardly and yields under a force in the opposite direction. The skis are thus able to separate from one another easily when they crossed over one another in deep snow in spite of the provision of this device. For this reason the other ski cannot be trapped on the other side of the device and cause serious injury.

SUMMARY OF THE INVENTION

The known anti-crossing device, however, is relatively complicated and thereby expensive. It is the object of this invention to provide a device of the kind previously indicated which, in comparison, is substantially simpler and more inexpensive. The present invention is characterized in that said upright member is molded from a flexible plastic, has a trough-shaped cross section profile and is mounted with the concave side of the trough-shaped portion turned inwardly. Use is hereby made of the physical nature of a trough-shaped, so to speak semi-hollow profile, wherein the rigidity against a bending force very greatly depends upon the direction of the bending force. Thereby it is assumed that the bending axis is perpendicular to the longitudinal direction of the trough like member and somewhat parallel to the plane defined by the rims of the trough. If the bending force presses against the concave, i.e. hollow side of the trough, it will show itself to be exceptionally rigid, whereas it will easily bend when the bending force acts in the opposite direction, namely from outside onto the ridge of the trough. Consequently the arrangement of the trough-shaped member on the ski must be so that the edges face toward the other ski, preferably forming a plane with a inner edge of the ski.

It is evident that the anti-crossing device can be molded from rubber or another elastomeric material preferably plastic of the high impact type, so that the device will not be damaged by the sharp edge of the other ski. Moreover the plastic should remain elastic at below zero temperatures. As an additional feature flexible strands, e.g. a steel cable or glass fibres, with low extensibility may be imbedded in the upright member especially in the rim or peripheral portion of that member.

A higher degree of stability of the upright member is achieved by designing it with an upward tapering or a wider ending downward. An arched profile is chosen preferably but it could also be a V-shaped profile. Furthermore, two or more parallel, unrelated upright members can be employed or these individual members can be pointwise or linearly related on their rims, so that a looped or W-shaped complete profile results.

The upper part of the upright member is designed preferably in the shape of a semi-dome. This increases the stability of the upright member and prevents injuries of the skier during a fall.

An object of the invention is to achieve the highest possible degree of stability of the upright member against a bending force acting outwardly. Another object is, however, to reduce the resistance against a bending force acting inwardly. A particularly great relative difference between both resistances is obtained by providing the upright member with longitudinal elongated slots extending almost to the upper end of the trough. This slots can be wider in the middle. Moreover the upright member can be provided with a reinforcing structure running lengthwise on the ridge, e.g. a stiffening longitudinal groove or web. The elongated slots increase the flexibility of the upright member upon bending inwardly without considerably reducing the rigidity in the other direction at the same time. On the other hand, the mentioned reinforcing structure increases the rigidity of the upright member against bending outwardly without simultaneously reducing flexibility considerably in the opposite direction.

The object of having both of the opposite moments of flexural resistance as different as possible is attained independently or in combination with the previously mentioned features by means of providing the lower portion of the upright member with a presumable bending area. This is a special area or point where the upright member will bend when it is pressed down or when it is pushed away by the tip of the other ski when this is brought out of the crossing position. The bending area may be designed in such manner as to be broadened sidewise by flattening the square section profile. It can readily be seen that the flexibility of the upright member is considerably improved by this feature especially at the beginning of the deformation. Rigidity in the opposite direction, however, is not influenced since the curved out edges of the upright member in the presumable bending area will stretch during the first phase of deformation and thereupon will result the same conditions with respect to stability as in the case of an almost equally shaped profile. There is even an additional advantage in sudden impacts being intercepted much better, thereby decreasing the local maximum stress in the material. This increases considerably the durability and performance of such a device.

It is advantageous to have the upright member molded as one piece with a substantially plate-shaped attaching base. This base is fastened on the surface of the ski by means of a two-sided adhesive foil. Since flexibility of the upright member is better in the middle portion or towards the top, it is advantageous to provide the attaching base with at least one web running transverse to the ski and ascending towards the upright member. Upon an involuntary crossing over in spite of the upright member the crossed ski will ascend on this rising wep during withdrawal as on a slope. The upright member is then bended inwardly at a point which lies substantially higher than the base plate.

BRIEF DESCRIPTION OF THE SEVERAL VIEWS OF THE DRAWING

Further objects and advantages of the invention will be apparent from the following description, refurence being had to the accompanying drawings, wherein a preferred embodiment of the invention is clearly shown in which:

FIG. 1 shows an anti-crossing device on the right ski shown in skiing direction. The ski tip is located behind the device.

FIG. 2 shows the left side view of the device according to FIG. 1.

FIG. 3 is a top view of the device according to FIG. 1.

FIG. 7 is a cross section of another upright member.

DETAILED DESCRIPTION OF THE PREFERRED EMBODIMENTS OF THE INVENTION

Figure 4:
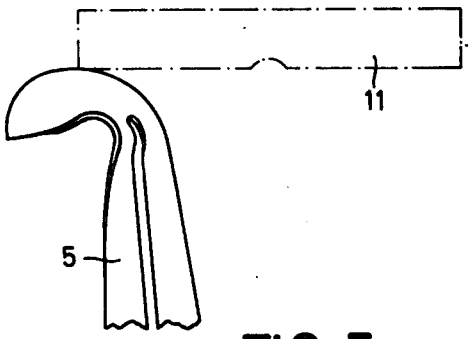
FIG. 4 is a view as in FIG. 1 wherein merely the upper part of the upright member is bended inwardly.
Figure 5:
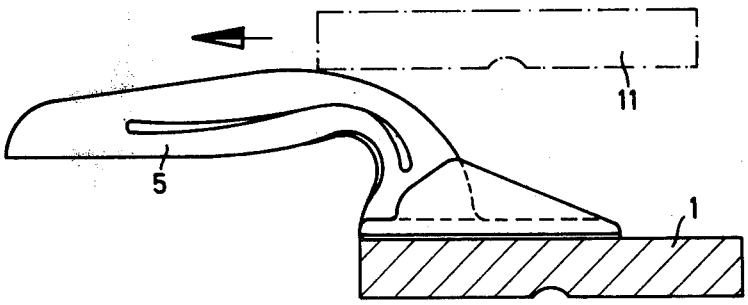
FIG. 5 is a view as in FIG. 1 with the upright member completely bended inwardly.
Figure 6:
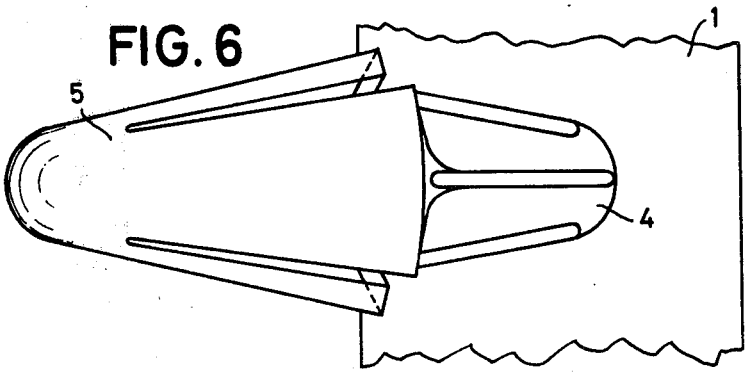
FIG. 6 is a top view of the bended device according to FIG. 5.

The right ski shown in FIGS. 1 to 6 is indicated by the number 1. An anti-crossing device is mounted on its surface by means of a two-sides adhesive foil 2 and flush with the left-hand inner edge of the ski. The anti-crossing device consists of a plate-shaped attaching base 4 making up unit with a trough-like upright member 5. The upright member 5 tapers upward and has an arched profile. It ends upward in a semi-dome, so that those edges of the trough curve over to one another at the top. Moreover, the upright member has two longitudinal slots 8. Three webs 9 that run transverse to the longitudinal direction of the ski and a cend towards the upright member are to be seen on the attachment base 4. These webs 9 are not connected with the upright member but end in a small distance from its ridge, thereby not influencing its bending characteristic. When the left ski (not shown in FIG. 1) strikes the edges 7 of the upright member in the direction of arrow 10, it shows itself to be resistant. On the other hand, if the left ski 11, shown in dot-dash lines, glides over the upright member, e.g. in deep snow, so that it is found on the right side, according to FIGS. 4 and 5, and crosses over the right ski 1, relatively slight pressure on the right side of the upright member is then sufficient to bend it over to the left. FIG. 4 shows this procedure when the left ski strikes the upright member at a pretty high point and FIG. 5 shows this when the point of impact lies further down. In every case, the webs 9 keep the other ski from striking a too low a point on the ridge of the upright member where it would have relatively great bending resistance.

FIG. 7 shows the profile of a different upright member with a stiffening groove 12 on the ridge. This upright member may be provided with other features as described above or as follows.

Figure 9:
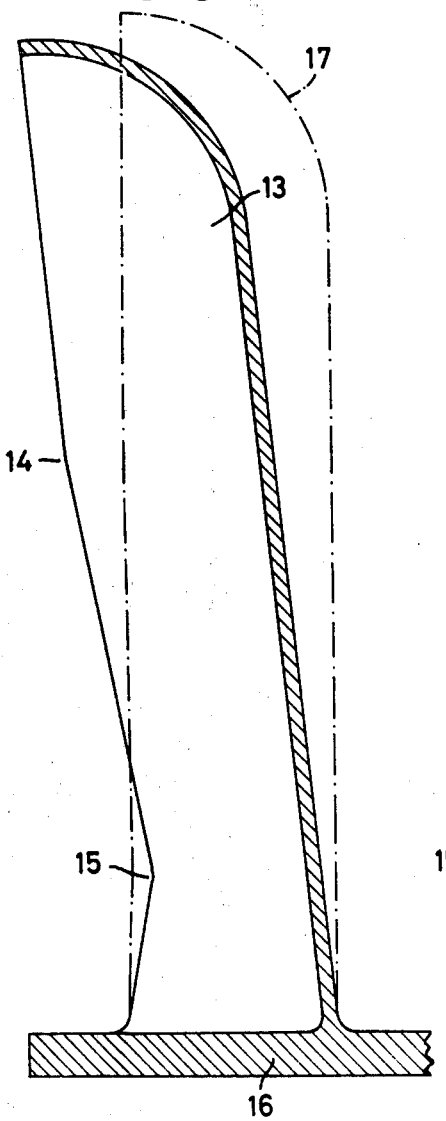
FIG. 8 is a view similar to that of FIG. 2 showing the concave or hollow side of a third anti-crossing device and FIG. 9 is a vertical section of the device according to FIG. 8 taken along line IX—IX. As this is a right device the view is in skiing direction.
Figure 8:
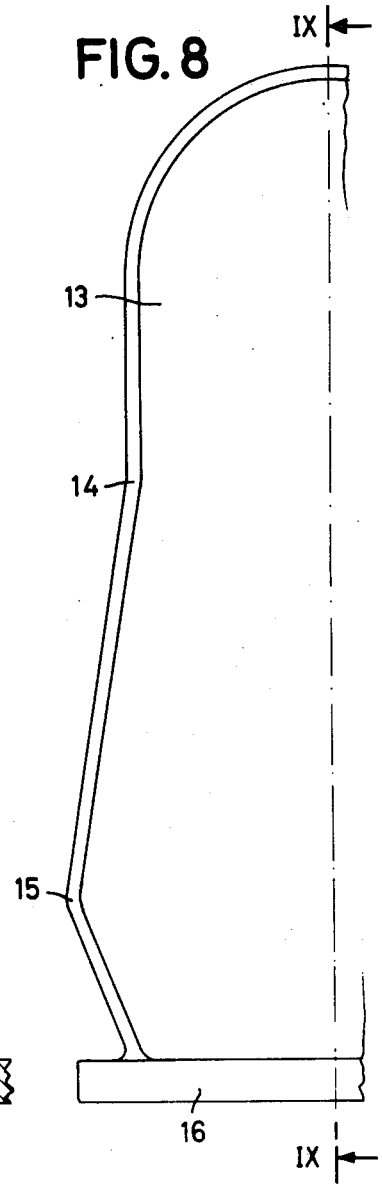

The upright member 13 shown in FIGS. 8 and 9 is provided with a so called presumable bending area. The semi-dome of this upright member is designed similarly to the type described first. The cross section profile below the semi-dome and down to those points of the edges designated by 14 is somewhat semi-circular. From there on downward, the profile flattens out, i.e., the width of the upright member in the view according to FIG. 8 increases until the widest points on the edges, the one of which is designated by 15. The arched horizontal profile at this point is flattened and then again changes downward into the semi-circular profile until the attachment base 16. Moreover, as FIG. 9 shows, this upright member is inclined a bit inwardly.

When the left ski impinges the edges of this upright member, it will yield flexibly at first and the edges will tighten. The upright member then goes into the vertical position 17, as shown by a dot-dash line in FIG. 9. In this position it now has the same rigidity against a further bending force directed outwardly as when the break in the curve of the edges, that one could also describe as bulging laterally outward, were not present. Of course, the upright member according to FIGS. 8 and 9 can also be supplied additionally with elongated slots and/or stiffening webs or grooves on the ridge as well as with webs on the attaching base rising to the break 15 of the edge.

What is claimed is:

1. Anti-crossing device for attachment to an upper surface of a ski adjacent to an inner longitudinal edge of the ski comprising an upright member and an attaching base, said upright member having longitudinally elongated slots and being molded from a flexible plastic material having a trough-shaped cross-section profile and being mounted with the concave side of the trough-shaped portion turned inwardly.

2. Anti-crossing device as in claim 1 wherein the cross section profile of the upright member is curved.

3. Anti-crossing device as in claim 2 wherein the cross section profile of the upright member contains a substantially circular arc portion.

4. Anti-crossing device as in claim 2 wherein the upright member ends at the top in the form of a semi-dome.

5. Anti-crossing device as in claim 1 wherein the upright member is tapered upward.

6. Anti-crossing device as in claim 1 wherein the lower portion of the upright member is provided with a presumable bending area where the member is broadened sidewise by the cross section profile being shaped eliptically.

7. Anti-crossing device as in claim 1 wherein the upright member is molded as one piece with a substantially plate-shaped attaching base.

8. Anti-crossing device as in claim 7 wherein the attaching base is provided with at least one web running transverse to the ski and ascending towards the upright member.

9. Anti-crossing device as in claim 1 wherein flexible strands with low extensibility are imbedded in the upright member especially in a peripheral portion of said member.

10. Anti-crossing device as in claim 2 wherein the upright member has a ridged portion and a lengthwise dimension, said ridge portion being provided with a reinforcing structure running with said lengthwise dimension.

* * * * *